US011761316B2

(12) United States Patent
Alders et al.

(10) Patent No.: US 11,761,316 B2
(45) Date of Patent: Sep. 19, 2023

(54) STEAM DIVERTER APPARATUS AND METHOD FOR CONTROLLING STEAM FLOW IN A WELL

(71) Applicant: TIER 1 ENERGY TECH, INC., Edmonton (CA)

(72) Inventors: Ronald Scott Alders, Cold Lake (CA); Jeffrey Golinowski, Sherwood Park (CA); Daniel P. Lupien, Edmonton (CA)

( * ) Notice: Subject to any disclaimer, the term of this patent is extended or adjusted under 35 U.S.C. 154(b) by 0 days.

(21) Appl. No.: 17/156,151

(22) Filed: Jan. 22, 2021

(65) Prior Publication Data

US 2021/0230990 A1 Jul. 29, 2021

Related U.S. Application Data

(60) Provisional application No. 62/965,655, filed on Jan. 24, 2020.

(51) Int. Cl.

| | |
|---|---|
| ***E21B 34/14*** | (2006.01) |
| ***E21B 43/24*** | (2006.01) |
| ***E21B 43/26*** | (2006.01) |
| ***E21B 43/27*** | (2006.01) |

(52) U.S. Cl.

CPC ..... *E21B 43/2405* (2013.01); *E21B 34/14* (2013.01); *E21B 43/261* (2013.01); *E21B 43/27* (2020.05)

(58) Field of Classification Search

CPC ..... E21B 34/14; E21B 43/24; E21B 43/2405; E21B 43/2406; E21B 43/261

See application file for complete search history.

(56) References Cited

U.S. PATENT DOCUMENTS

| | | | | |
|---|---|---|---|---|
| 3,071,193 | A * | 1/1963 | Raulins | E21B 34/14 285/321 |
| 3,395,758 | A * | 8/1968 | Kelly | E21B 43/14 166/100 |
| 5,156,220 | A * | 10/1992 | Forehand | E21B 33/1208 166/332.7 |
| 9,115,565 | B1 * | 8/2015 | Richards | E21B 34/14 |
| 10,597,977 | B2 * | 3/2020 | Thomas | E21B 34/10 |
| 10,648,287 | B2 * | 5/2020 | Styler | E21B 34/14 |
| 2012/0073828 | A1 * | 3/2012 | Churchill | E21B 34/10 166/334.4 |
| 2017/0254176 | A1 * | 9/2017 | van Petegem | E21B 34/10 |

* cited by examiner

*Primary Examiner* — Matthew R Buck
(74) *Attorney, Agent, or Firm* — Bennett Jones LLP

(57) ABSTRACT

A steam diverter apparatus for forming part of a downhole tubing string is provided. The apparatus may be used in a SAGD operation to control flow of steam into a formation. The apparatus includes a tubular housing defining steam-admitting ports, and containing a moveable shift sleeve. The apparatus is modifiable for use with position shifting tools of different outer diameters by interchanging first and second sets of the shift sleeve and insert rings having different minimum inner diameters within the housing. The open flow area of the apparatus is modifiable by plugs that block the ports and are removably attached to the housing. The plug, the shift sleeve, or both of them may be made of a dissolvable material, so that they can be dissolved by a chemical solution injected into the tubing string, for the purpose of controlling steam flow through the ports.

12 Claims, 6 Drawing Sheets

STEAM DIVERTER APPARATUS AND METHOD FOR CONTROLLING STEAM FLOW IN A WELL

CROSS-REFERENCE TO RELATED APPLICATION

The present application claims the priority benefit of U.S. Provisional Application No. 62/965,655 filed Jan. 24, 2020, the entire contents of which are incorporated herein by reference.

FIELD OF THE INVENTION

The present invention relates to a steam diverter apparatus and a method for controlling steam flow in a well, which may be used for a SAGD operation.

BACKGROUND OF THE INVENTION

Steam-assisted gravity drainage (SAGD) is a technique for recovering viscous hydrocarbons (e.g., heavy crude oil and bitumen) that do not readily flow under normal reservoir conditions. SAGD involves injecting steam into an injection tubing string of a horizontal injection well, and allowing the steam to flow into the surrounding formation to heat and thereby reduce the viscosity of the hydrocarbons in the formation. The reduced-viscosity hydrocarbons flow downward into a substantially horizontal production well, and are pumped to the surface through a production tubing string of the production well.

The injection tubing string includes an apparatus referred to as a steam diverter for controlling the flow of steam from the injection tubing string to the surrounding formation. A conventional steam diverter includes a tubular housing that defines ports for admitting steam through the housing, and a shift sleeve that moves axially within the housing between closed and open positions to prevent and permit flow of steam through the ports.

A conventional steam diverter is a ready-made or a made-to-order paired combination of the housing and the shift sleeve. An operator may select a steam diverter having regard to a variety of design parameters including its minimum inner diameter and the flow area of the ports. The minimum inner diameter is defined by the housing and the shift sleeve, as both parts are profiled for use with a position shifting tool for moving the shift sleeve. Therefore, a change in the desired minimum inner diameter of the steam diverter requires a change of both the housing and the shift sleeve. Once the steam diverter is selected, a workshop operator sets the shift sleeve to its closed position. A field operator makes up the injection tubing string to include the steam diverter. It would be desirable if the minimum inner diameter and the open flow area of the ports of the steam diverter could be conveniently modified to suit conditions identified in the field.

Once installed in the injection tubing string, the steam diverter is run into the injection well with the shift sleeve is in the closed position so that fluid can be circulated through the steam diverter during or after the run-in operation. When steam is to be injected into the formation, a position shifting tool on coiled tubing is run into the injection tubing string to move the shift sleeve to its open position. It would be desirable if the coiled tubing operation could be avoided to reduce the time and cost of the steam injection process.

SUMMARY OF THE INVENTION

The present invention relates to a steam diverter apparatus for forming part of a downhole tubing string, and a method for controlling steam flow in a well, which may be used for a SAGD operation.

In a first aspect, the present invention comprises a steam diverter apparatus with a tubular housing, a removable shift sleeve, and one or more removable insert rings. These features permit modification of the minimum inner diameter of the apparatus to suit position shifting tools of different outer diameters, without having to replace the housing. The housing defines an axially extending central bore for communication of fluid with the tubing string, and at least one transversely extending port for communication of steam from the bore to outside of the housing. The shift sleeve is removably disposed within the bore, and moveable relative to the housing between a closed position and an open position wherein the shift sleeve prevents and permits, respectively, communication of steam through the at least one port from the bore to outside of the housing. The insert ring is removably attached to the housing, and disposed concentrically within the bore, and axially in line with the shift sleeve. The shift sleeve and the at least one insert ring have a minimum inner diameter that are substantially the same. The insert ring may define a release profile for actuating radial retraction of a key of a position shifting tool when the release profile is engaged by the position shifting tool. The insert ring may be removably attached to the housing by a threaded connection. The insert ring may abut an internal shoulder of the housing when attached to the housing. The insert ring may comprise an upper insert ring and a lower insert ring, wherein the shift sleeve is disposed axially between the upper insert ring and the lower insert ring. The housing may comprise an upper housing and a lower housing removably attached to the lower housing, wherein the upper insert ring is removably attached to the upper housing, and wherein the lower insert ring is removably attached to the lower housing. In a method of the present invention, the inner diameter of the apparatus may be modified by substituting a first set of a shift sleeve and insert ring, both having a first minimum inner diameter, with a second set of shift sleeve and insert ring, both having a second minimum inner diameter that is different from the first minimum inner diameter. The housing and sets of the shift sleeve and the insert ring may be provided as a kit of parts.

In a second aspect, the present invention comprises a steam diverter apparatus that comprises a tubular housing, a shift sleeve, and at least one plug. These features permit modification of the open flow area of the ports. The housing defines an axially extending central bore for communication of fluid with the tubing string, and a plurality of transversely extending ports for communication of steam from the bore to outside of the housing. The shift sleeve is disposed within the bore, and moveable relative to the housing between a closed position and an open position wherein the shift sleeve prevents and permits, respectively, communication of steam through the ports from the bore to outside of the housing. The plug is removably attached to the housing, wherein the plug prevents communication of steam through one of the ports from the bore to outside of the housing. The plug may be removably attached to the housing by a threaded connection. The plug may comprise a head adapted for engagement by a drive tool. The apparatus may also comprise a diverter sleeve disposed around the plugs, removably attached to the housing, and defining at least one conduit for communication of steam from the ports to outside of the diverter sleeve, and wherein the at least one plug is accessible from outside of the housing when the diverter sleeve is detached from the housing. The apparatus may also comprise a lock ring that is removably attached to the housing by a threaded connection and that abuts against the diverter sleeve to removably attach the diverter sleeve to the housing. In a method of the present invention, the open flow area of the apparatus may be modified by selectively blocking one or more of the ports with one or more plugs.

In a third aspect, the present invention comprises a steam diverter apparatus with a partly dissolvable tubular housing. This feature permits control of the steam flow into a formation without the need to run a position shifting tool into the tubing string to open the apparatus. This feature also permits fluid to be circulated through the tubing string while a shift sleeve of the apparatus (if present) is in the open position. The housing defines an axially extending central bore for communication of fluid with the tubing string. The housing comprises a first portion that defines at least one transversely extending port for communication of steam from the bore to outside of the housing. The first portion is formed by a first material. The housing comprises at least one second portion that blocks communication of steam through one of the ports. The second portion is formed by a second material that dissolves at a higher dissolution rate than does the first material when exposed to a chemical solution. The apparatus may also comprise a shift sleeve disposed within the bore, and moveable relative to the housing between a closed position and an open position wherein the shift sleeve prevents and permits, respectively, communication of steam through the at least one port from the bore to outside of the housing. The second portion of the housing may comprise a plug removably attached to the first portion of the housing. The plug may be removably attached to the first portion of the housing by a threaded connection. In a method of the present invention, control of steam flow into a formation is effected by including the apparatus in a downhole tubing string disposed within the formation, injecting the chemical solution into the tubing string, and allowing the chemical solution to flow into the bore to contact and dissolve the second portion of the housing to thereby unblock the at least one of the ports. The step of injecting the chemical solution may be performed while the shift sleeve (if present) is in the open position.

In a fourth aspect, the present invention comprises a steam diverter apparatus with a tubular housing and a dissolvable inner sleeve. This feature also permits control of steam flow into a formation without the need to run a position shifting tool into the tubing string to open the apparatus. The housing defines an axially extending central bore for communication of fluid with the tubing string, and at least one transversely extending port for communication of steam from the bore to outside of the housing. The housing is formed by a first material. The shift sleeve is disposed within the bore at a closed position wherein the shift sleeve prevents communication of steam through the at least one port from the bore to outside of the housing. The shift sleeve is formed by a second material that dissolves at a higher dissolution rate than does the first material when exposed to a chemical solution. The sleeve may comprise a shift sleeve movable relative to the housing between the closed position and an open position wherein the shift sleeve permits communication of steam through the at least one port from the bore to outside of the housing. In a method of the present invention, control of steam flow into a formation is effected by including the apparatus in a downhole tubing string disposed within the formation, and while the sleeve is in the closed position, injecting the chemical solution into the tubing string, and allowing the chemical solution to flow into the bore to contact and dissolve the shift sleeve to thereby permit communication of steam through the at least one port from the bore to outside of the housing.

BRIEF DESCRIPTION OF THE DRAWINGS

In the drawings, like elements may be assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention.

DETAILED DESCRIPTION OF EMBODIMENTS OF THE INVENTION

Figure 1:
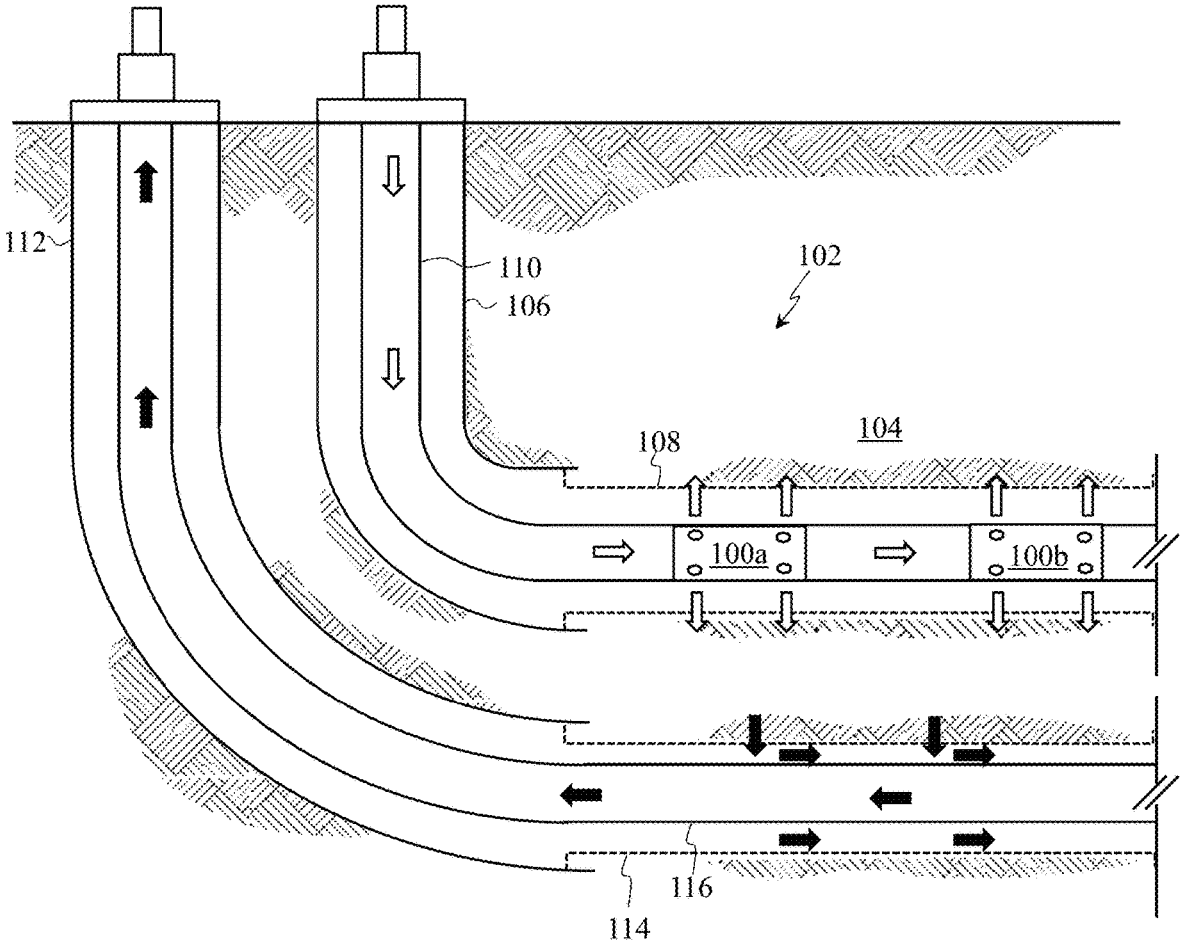
FIG. 1 shows a SAGD system including apparatuses of the present invention.
Figure 2:
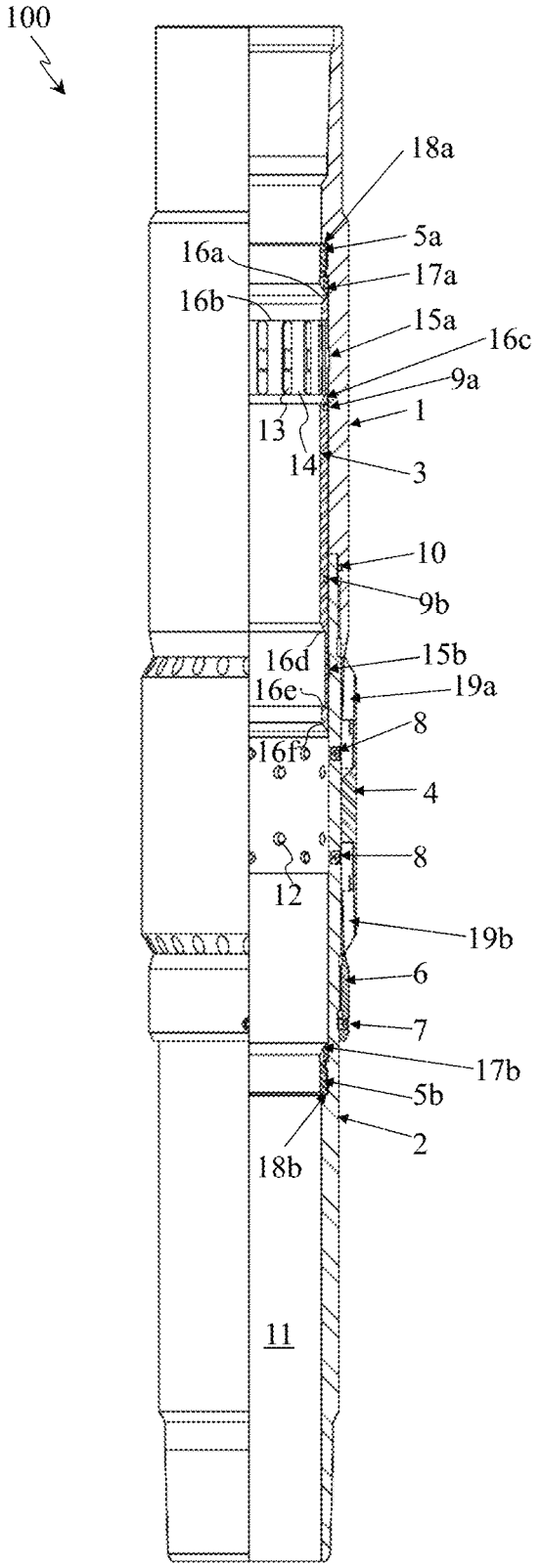
FIG. 2 shows an axial quarter-section view of an embodiment of an apparatus of the present invention, with the shift sleeve in its open position.
Figure 3:
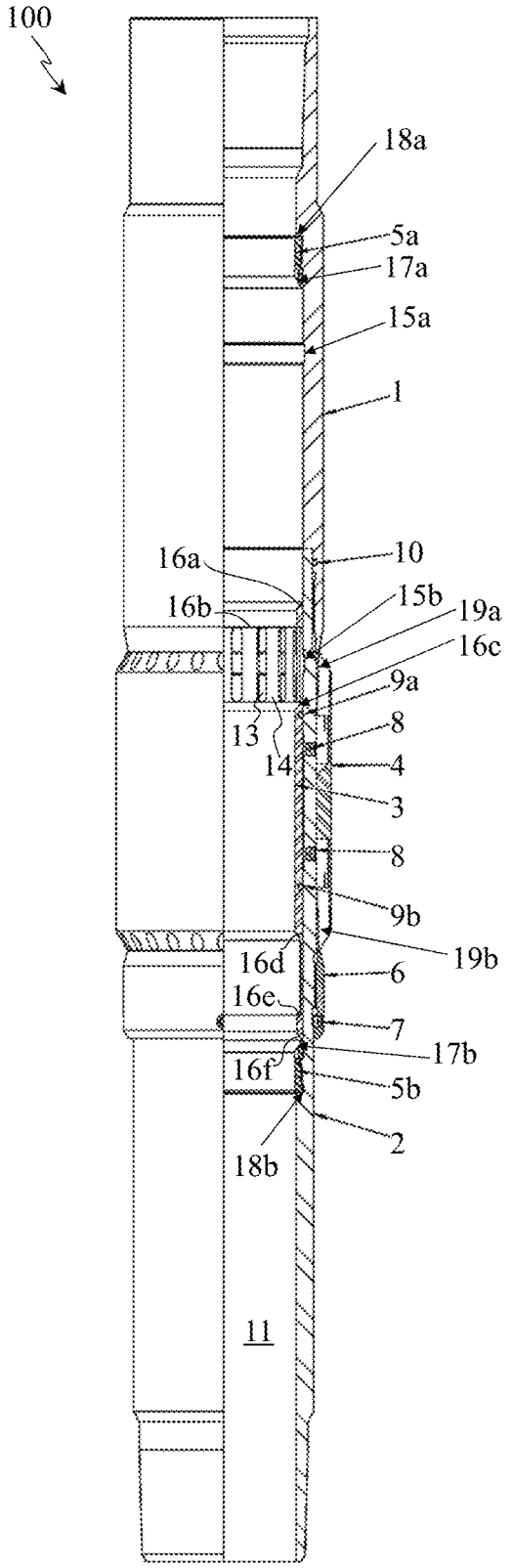
FIG. 3 shows an axial quarter-section view of the apparatus of FIG. 2, with the shift sleeve in its closed position.

Definitions.

The present invention relates to a steam diverter apparatus and a method for controlling steam flow in a well, which may be used for a SAGD operation. Any term or expression not expressly defined herein shall have its commonly accepted definition understood by a person skilled in the art.

The term "axial" describes the direction coinciding with the central longitudinal axis of a well, a tubing string, or the apparatus (100) of the present invention, as the case may be. For example, in FIG. 1, the axial direction of the horizontal legs of the wells coincide with the horizontal direction of the drawing plane; and in FIGS. 2 to 6C, the axial direction of the apparatus (100) coincides with the vertical direction of the drawing plane.

The term "transverse" describes a direction perpendicular to the axial direction. For example, in FIG. 1, transverse directions of the horizontal legs of the wells include the vertical direction of the drawing plane, and the direction perpendicular to the drawing plane; and in FIGS. 2 to 6C, transverse directions of the apparatus (100) include the horizontal direction of the drawing plane, and the direction perpendicular to the drawing plane.

The terms "upper" and "lower", and like terms, describe relatively axially uphole and downhole parts, without limiting their elevation in use. For example, in FIG. 1, apparatuses (100*a*, 100*b*) may be described as an upper apparatus and a lower apparatus, respectively, even though situated at substantially the same elevation; and in FIGS. 2 and 6C, parts (1, 2) are described as an upper housing (1) and lower housing (2), respectively, even though they are situated at substantially the same elevation when included in the horizontal of injection tubing string (110) shown in FIG. 1.

SAGD System.

FIG. 1 shows steam diverter apparatuses (100*a*, 100*b*) of the present invention installed in a SAGD system (102) within a subterranean hydrocarbon-bearing formation (104). An injection well casing (106) and a perforated injection well liner (108) define an injection well containing an injection tubing string (110) including the apparatuses (100*a*, 100*b*). A production well casing (112) and a production well liner (114) define a production well containing a production tubing string (116). The horizontal leg of the production well is below and substantially parallel to a horizontal leg of the injection well.

In use, a steam generator (not shown) injects steam (denoted by the white arrows in FIG. 1) into the injection tubing string (110). The apparatuses (100*a*, 100*b*) are used to control flow of steam from inside the injection tubing string (110) to the formation surrounding the injection well. As described below, the control of the flow of steam may be effected by movement of the shift sleeve (3) of the apparatuses (100*a*, 110*b*), dissolution of a dissolvable portion of the housing (1, 2) of the apparatuses (100*a*, 100*b*), dissolution of the shift sleeve (3) of the apparatuses (100*a*, 100*b*), or a combination of any such features. Use of an upper apparatus (100*a*) and a lower apparatus (100*b*) allow for zonal and sequential control of steam injection into the formation (104). The injected steam flows through the perforated injection well liner (108) and into the surrounding formation (104), thereby heating in situ hydrocarbons. Reduced-viscosity hydrocarbon and condensed steam (denoted by the black arrows in FIG. 1) flow downwards in the formation (104), through the perforated production well liner (114) and into the production tubing string (116). This fluid is pumped through the production tubing string (116) to the surface.

Steam Diverter Apparatus.

FIGS. 2 to 5 show different views of one embodiment of a steam diverter apparatus (100) used in the system of FIG. 1, as further described below. The apparatus (100) includes a tubular housing (1, 2), an inner shift sleeve (3), an outer diverter sleeve (4), upper and lower insert rings (5*a*, 5*b*), lock ring (6), set screw (7), plugs (8), and O-ring seals (9*a*, 9*b*, 10). The parts, other than O-ring seals (9*a*, 9*b*, 10), may be made of an alloy steel having metallurgical properties suitable for withstanding anticipated pressures, temperatures, and chemical conditions in the injection well. The O-ring seals (9*a*, 9*b*, 10) may be made of conventional elastomers, such as a steam and hydrocarbon-resistant elastomer, such as Thermanite™ (Rubberatkins Ltd., Aberdeen UK).

In particular embodiments, the shift sleeve (3) or the plugs (8), or both of them, may be made of a material that dissolves when exposed to a chemical solution, such as an acidic fluid, or a caustic fluid, or a combination thereof, which may be injected into the injection tubing string (110). Dissolvable materials suitable for use in downhole tools are known in the art and are commercially available, with non-limiting examples including metals (e.g., magnesium, aluminum, and alloys thereof), composites (e.g., epoxy resins and fiberglass), rubbers, and polymers (e.g., polyglycolic acid (PGA) or polylactic acid (PLA)).

Housing.

The tubular housing (1, 2) defines an axially-extending central bore (11) for communication of fluid (e.g., steam, liquid, gas, or mixtures of liquid and gas) with uphole and downhole portions of the injection tubing string (110). The tubular housing (1, 2) also defines transversely extending ports (12) for the passage of steam from inside the bore (11) through the housing (1, 2).

In the embodiment shown in FIGS. 2 to 5, the tubular housing (1, 2) is formed by an upper housing (1) and a lower housing (2), which are removably connected by a threaded connection, made fluid-tight by the O-ring seal (10). The upper housing (1) has a threaded box end for removable connection to the uphole portion of the injection tubing string (110), while the lower housing (2) has a threaded pin end for removable connection to the downhole portion of the injection tubing string (110). In other embodiments, different means may be used to connect the upper and lower housings (1, 2) to each other, and to the portions of the injection tubing string (110).

In the embodiment shown in FIGS. 2 to 5, the lower housing (2) defines the ports (12) in four axially-spaced apart rows. Each row has an equal number of equally sized, circumferentially spaced-apart ports (12). The ports (12) of the upper pair and lower pair of rows are circumferentially staggered relative to each other. In other embodiments, the ports (12) may be defined by the upper housing (1), or by both the upper and lower housings (1, 2), and may differ in their size, shape, number, and arrangement.

Diverter Sleeve and Lock Ring.

The diverter sleeve (4) is used to effect a desired distribution of steam exiting the ports (12), and to protect the plugs (8) and ports (12). The diverter sleeve (4) can be removed from the housing (1, 2), so that an operator can visually inspect and access the ports (12) for modifying their open flow area, as discussed below.

In the embodiment shown in FIGS. 2 to 5, the diverter sleeve (4) defines a plurality of circumferentially spaced apart upper conduits (19*a*) and lower conduits (19*b*) that encircle the housing (1, 2) and are in communication with the ports (12). The upper conduits (19*a*) and lower conduits (19*b*) extend axially upwards and downwards, respectively, from an inner opening of the diverter sleeve (4) to an outer opening of the diverter sleeve (4). The upper conduits (19*a*) and lower conduits (19*b*) are oriented to radiate steam around the apparatus (100) in uphole and downhole directions, respectively, at a slight angle away from the apparatus (100), as shown by the dashed lines in FIG. 4. Accordingly, this embodiment of the diverter sleeve (4) provides for biaxial injection of steam, distributed in a relatively uniform manner around the apparatus (100). In other embodiments, the conduits of the diverter sleeve (4) may be modified to distribute steam in other patterns.

In the embodiment shown in FIGS. 2 to 5, the diverter sleeve (4) is removably secured to the housing (1, 2) using a lock ring (6) and the set screw (7). The diverter sleeve (4) and lock ring (6) slide onto the lower housing (2) from its lower end. The lock ring (6) has a threaded inner wall for removable attachment to a threaded outer wall of the lower housing (2). When so assembled, the diverter sleeve (4) abuts against the lower end of the upper housing (1), and the upper end of the lock ring (6). The threaded set screw (7) is of conventional design and is screwed into a threaded aperture of the lock ring (6) to engage the outer wall of the lower housing (2), and thereby prevent inadvertent release of the lock ring (6) from the lower housing (2).

Plugs.

Figure 4:
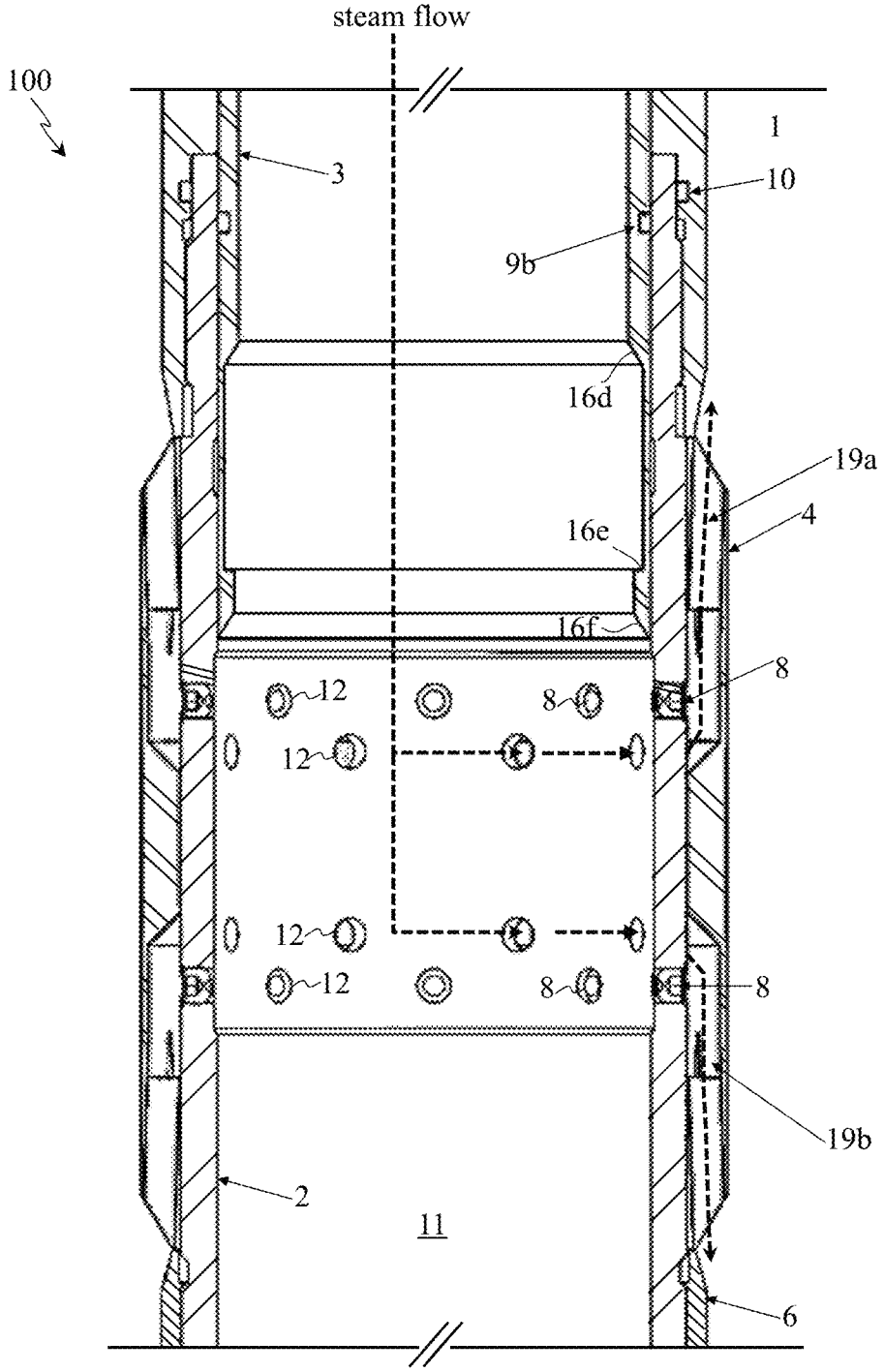
FIG. 4 shows an axial half-section view of a portion of the apparatus of FIG. 2, with the shift sleeve in its open position, at an enlarged scale relative to FIG. 2.
Figure 5:
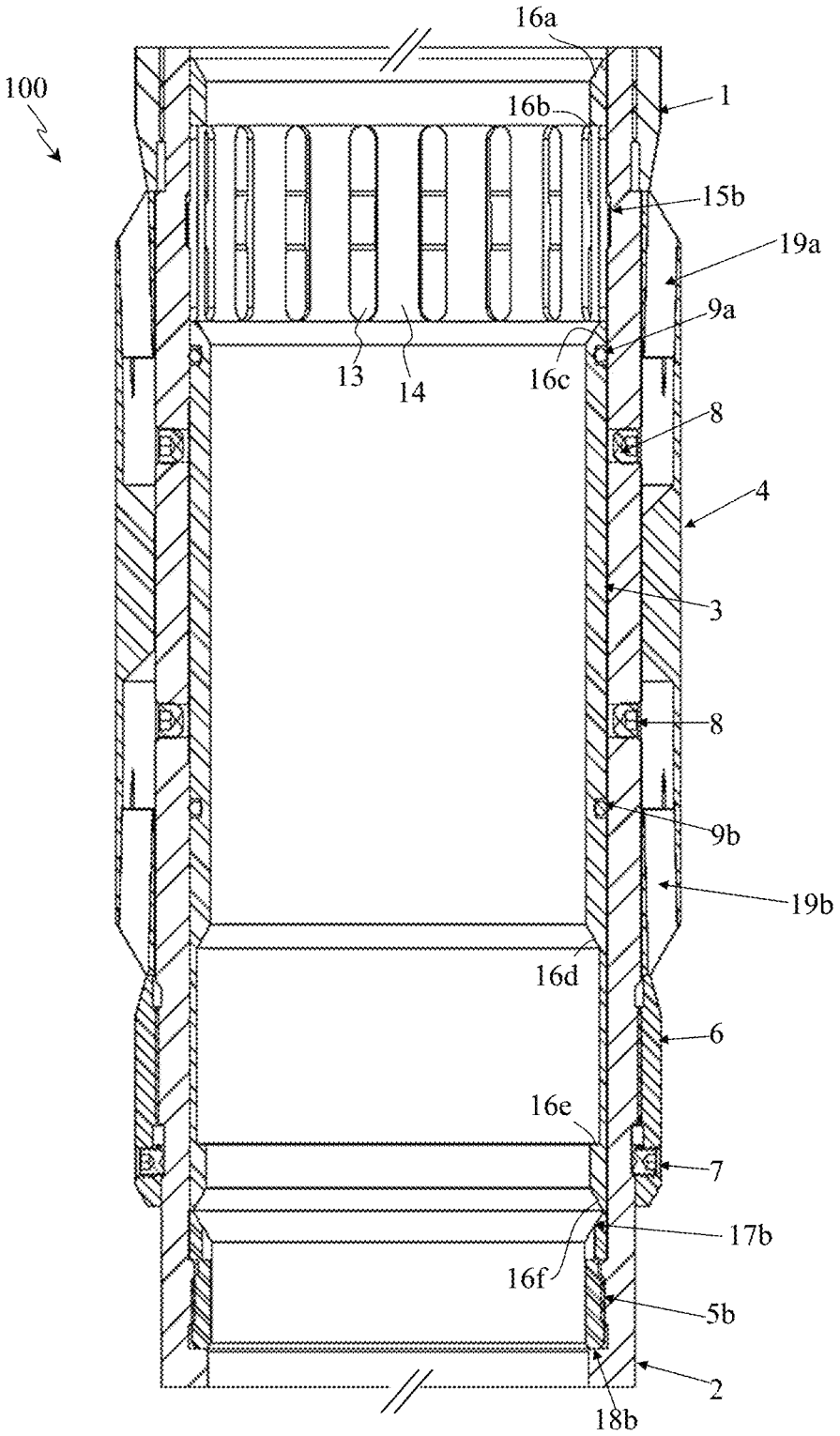
FIG. 5 shows an axial half-section view of a portion of the apparatus of FIG. 2, with the shift sleeve in its closed position, at an enlarged scale relative to FIG. 2.

Some or all of the ports (12) may be selectively blocked with a plug (8) to prevent steam flowing through the port (12) from the bore (11) to outside of the housing (1, 2). As such, the plugs (8) may be used to adjust the open flow area of the ports (12)—i.e., the total cross-sectional area of the ports (12) that is not blocked. In FIG. 4, for example, plugs (8) block the uppermost and lowermost rows of the four rows of ports (12), but not the two intermediate rows of the ports (12), so that the open flow area of the ports (12) is half of the total cumulative area of the ports (12).

In the embodiment shown in FIGS. 2 to 5, the outer end of the plugs (8) are visible to an operator from the exterior of the housing (1, 2), when the diverter sleeve (4) is removed to reveal the ports (12) as described above. Therefore, an operator may conveniently determine the open flow area of the ports (12) by counting the number of plugs (8).

In the embodiment shown in FIGS. 2 to 5, each plug (8) may be threaded into a port (12). The inner end of the plug (8) has a cup-shaped point, while the outer head is adapted to be engaged and driven by a tool such as a hex key or screw driver head, or a wrench or a socket. In embodiments, the outer head of plug (8) and the outer head of set screw (7) used to secure the lock ring (6) may have the same head design and size, which allows for single tool to be used. In other embodiments, means other than a threaded connection may be used to removably attach the plugs (8) to the housing (1, 2), and the plugs (8) may have forms different than a set screw.

Dissolvable Plugs or Other Portion of the Housing.

In embodiments of the apparatus (100), some or all of the plugs (8) may comprise a material that dissolves when exposed to a chemical solution. Accordingly, the apparatus (100) may be installed in the injection tubing string (110), and run into the injection with the shift sleeve (3) in the open position. As long as a sufficient number of the ports (12) are plugged (whether with dissolvable plugs (8) or otherwise) to limit flow out of the ports (12) to an acceptable degree, fluid may be circulated through the apparatus (100) for a variety of well operations. When it is desired to inject steam into the formation (104), a chemical solution is pumped into injection tubing string (100) to dissolve the dissolvable plugs (8) and thereby unplug their associated ports (12), with the shift sleeve (3) remaining in the open position. When it is desired to cease to steam injection into the formation (104), the shift sleeve (3) may be moved to the closed position. Accordingly, the use of dissolvable plugs (8) allows for initiation of steam injection into the formation (104) without having to run a position shifting tool into the injection tubing string (110) to move the shift sleeve (3) from the closed position to the open position. Further, since a shift sleeve (3) is not strictly necessary to control initial flow of steam through the ports (12), the use of dissolvable plugs (8) allow for embodiments of the apparatus (100) which do not have a shift sleeve (3).

In embodiments where the plugs (8) are made of a dissolvable material, the plugs (8) may be either removably or permanently attached to the housing (1, 2). For example, the plugs (8) may be affixed to the housing (1, 2) by means that do not allow for removal of the plugs (8) from the housing (1, 2). When the plugs (8) are attached to the housing (1, 2), whether removably or permanently, the plugs (8) may be considered as forming a dissolvable second portion of the housing (1, 2). The remainder of the housing (1, 2) (i.e., the portion excluding the dissolvable plugs (8)) may be considered as forming a non-dissolvable first portion of the housing (1, 2) that defines the ports (12). As used in this context, the terms "dissolvable" and "non-dissolvable" may be understood to be relative terms, with a dissolvable material being one that dissolves more readily (i.e., has a higher dissolution rate, in terms of mass per unit time) than does a non-dissolvable material when exposed to a chemical solution, even though the non-dissolvable material may actually dissolve to some degree or not at all when exposed to the chemical solution. The person of ordinary skill in the art will be able to select among available first and second materials to form the first and second portions, respectively, with the second material having the higher dissolution rate for a particular chemical solution.

Shift Sleeve.

The shift sleeve (3) is movable axially relative to the tubular housing (1, 2) between an open position and a closed position, which respectively permit and prevent steam flow through the ports (12) from the bore (11) to outside of the housing (1, 2).

In the embodiment shown in FIGS. 2 to 5, the shift sleeve (3) is cylindrical and is sealed against the inner wall of the housing (1, 2), by means of upper and lower O-ring seals (9*a*, 9*b*). When the shift sleeve (3) is in the open position (FIGS. 2 and 4), the ports (12) are exposed to the bore (11), to permit steam flow through the ports (12) as shown by the dashed lines in FIG. 4. Conversely, when the shift sleeve (3) is in the closed position (FIGS. 3 and 5), the ports (12) are positioned axially between the O-ring seals (9*a*, 9*b*) and covered by the shift sleeve (3), and therefore isolated from the bore (11).

In the embodiment shown in FIGS. 2 to 5, the shift sleeve (3) includes a collet mechanism for retaining the shift sleeve (3) in the open position or the closed position. The upper portion of the shift sleeve (3) defines openings (13) separated by collet strips (14). The collet strips (14) are thinner than portions of the shift sleeve (3) which are immediately axially proximate. The collet strips (14) are thus relatively flexible in comparison to those axially proximal portions. The outer surface of each collet strip (14) forms a protrusion that may engage an upper locking recess (15*a*) and a lower locking recess (15*b*) defined by the inner wall of the housing (1, 2) to retain the shift sleeve (3) in the open position or the closed position, respectively. In other embodiments, other mechanisms may be used to retain the shift sleeve (3) in the open and closed positions.

Dissolvable Shift Sleeve.

In embodiments of the apparatus (100), the shift sleeve (3) itself may be made of a material that dissolves more readily (i.e., at a higher dissolution rate, in terms of mass per unit time) than a material that forms the housing when exposed to a solvent or chemical solution. The person of ordinary skill in the art will be able to select among available different first and second materials to form the housing and the shift sleeve, respectively, with the second material having the higher dissolution rate for a particular chemical solution. The first material may dissolve to some degree or not at all when exposed to the chemical solution. Accordingly, the chemical solution may be pumped into injection tubing string (100) to dissolve the shift sleeve (3) while in the closed position, and thereby expose the ports (12) to the bore (11). If the ports (12) are plugged with dissolvable plugs (8), as described above, then the dissolvable plugs (8) may also be dissolved by the same injected chemical solution, or a different chemical solution. Accordingly, the use of a dissolvable shift sleeve (3) allows for initiation of steam injection into the formation (104) without having to run a position shifting tool on coiled tubing into the injection tubing string (110) to move the shift sleeve (3) from the closed position to the open position. Further, since the shift sleeve (3) does not necessarily have to move to control flow of steam through the ports (12), the use of a dissolvable sleeve (3) allows for embodiments of an apparatus (100) in which the sleeve is non-movable relative to the housing (1, 2).

Shift Sleeve and Insert Rings for Use with Position Shifting Tool.

The apparatus (100) may be adapted for use with a position shifting tool that is run into the injection tubing string (110) to move the shift sleeve between the open and closed positions. As a non-limiting example, the embodiment of the apparatus (100) shown in FIGS. 2 to 5 is adapted for actuation by a position shifting tool that functions in accordance with principles described in U.S. Pat. No. 3,051,243 (Grimmer et al.; 1962-08-28), and which may be an Otis B™ shifting tool (Halliburton Company; Houston, Tex., USA). In brief, such a position shifting tool has keys that can retract and expand radially to engage an abrupt shoulder profile. The keys are disposed between an upper cam and a lower cam, each of which causes the keys to retract when one of the cams engages a beveled shoulder release profile.

In the embodiment shown in FIGS. 2 to 5, the apparatus (100) has the following features, proceeding from the upper end to the lower end of the apparatus (100). The upper insert ring (5*a*) comprises an external, downward-facing beveled shoulder release profile (17*a*) at its lower end. The shift sleeve (3) internally defines an upward-facing beveled shoulder release profile (16*a*) at its upper end, a downward-facing abrupt shoulder (16 *b*), an upward-facing beveled shoulder release profile (16 *c*), a downward-facing beveled shoulder release profile (16*d*), an upward-facing abrupt shoulder (16*e*), and a downward-facing beveled shoulder release profile (16*f*) at its lower end. The lower insert ring (5 *b*) comprises an external, upward-facing beveled shoulder release profile (17*b*) at its upper end. In other embodiments, the shift sleeve (3) and insert rings (5*a*, 5*b*) may be adapted for use with other position shifting tools. In other embodiments, the release profiles (17*a*, 17*b*) defined by the shift sleeve (3) and the insert rings (5*a*, 5*b*) may be in a form different from beveled shoulders. In other embodiments, the insert rings (5*a*, 5*b*) may not be required, depending on functioning of the position shifting tool.

When the shift sleeve (3) is to be moved downward from the open position (FIGS. 2 and 4) to the closed position (FIGS. 3 and 5), the position shifting tool is inserted downwardly into the housing (1, 2). Engagement of the lower cam of the position shifting tool with beveled shoulder release profile (16*a*) and subsequently beveled shoulder release profile (16*c*) causes the keys of the position shifting tool to retract inwardly. This allows the position shifting tool to move downwardly until its keys engage with the abrupt shoulder (16*e*). Continued application of downward force to the position shifting tool causes the collet strips (14) to bend inwardly so their protrusions disengage from the upper locking recess (15*a*). The shift sleeve (3) moves downwardly until the protrusions of the collet strips (14) engage the lower locking recess (15*b*) to retain the shift sleeve (3) in the closed position. In the closed position, the lower end of the shift sleeve (3) abuts against the lower insert ring (5*b*). If it is desired to retract the position shifting tool, then an upward force is applied thereto so that its upper cam engages with the beveled shoulder release profile (16*d*). This causes the keys of the position shifting tool to retract, thus allowing the position shifting tool to move upwardly through the injection tubing string (110) while the shift sleeve (3) remains in the closed position. Alternatively, if it is desired to continue moving the position shifting tool downhole, then a downward jarring force is applied thereto so that its lower cam engages the beveled shoulder release profile (17*b*). This causes the keys of the position shifting tool to retract, thus allowing the position shifting tool to move downwardly through the injection tubing string (110) while the shift sleeve (3) remains in the closed position.

When the shift sleeve (3) is to be moved upward from the closed position (FIGS. 3 and 5) to the open position (FIGS. 2 and 4), the position shifting tool is inserted in an inverted orientation, and positioned downhole of the shift sleeve (3). The position shifting tool is pulled upwardly so that engagement of the upper cam thereof with beveled shoulder release profile (16*f*) and subsequently beveled shoulder release profile (16*e*) causes the keys of the position shifting tool to retract inwardly. This allows the position shifting tool to move upwardly until its keys engage with the abrupt shoulder (16*b*). Continued application of upward force to the position shifting tool causes the collet strips (14) to bend inwardly so that their protrusions disengage from the lower locking recess (15*b*). The shift sleeve (3) moves upwardly until the protrusions of the collet strips (14) engage the upper locking recess (15*a*) to retain the shift sleeve (3) in the open position. In the open position, the upper end of the shift sleeve (3) abuts against the upper insert ring (5*a*). If it is desired to move the position shifting tool downhole, then a downward force is applied thereto so that its lower cam engages the beveled shoulder release profile (16*c*). This causes the keys of the position shifting tool to retract, thus allowing the position shifting tool to move downwardly through the injection tubing string (110) while the shift sleeve (3) remains in the open position. Conversely, if it is desired to retract the position shifting tool uphole, then an upward jarring force is applied thereto so that its upper cam thereof engages the beveled shoulder release profile (17*a*) of the upper insert ring (5*a*). This causes the keys of the position shifting tool to retract, thus allowing the position shifting tool to move upwardly through the injection tubing string (110) while the shift sleeve (3) remains in the open position.

Shift Sleeve and Insert Rings for Modification of Inner Diameter of Apparatus.

In the embodiment shown in FIGS. 2 to 5, the shift sleeve (3) and the insert rings (5*a*, 5*b*) have substantially the same minimum inner diameter. The insert rings (5*a*, 5*b*) are removably attached to the housing (1, 2). The shift sleeve (3) and insert rings (5*a*, 5*b*) and may be removed from the housing (1, 2) when the upper housing (1) and lower housing (2) are detached from each other. Accordingly, the removed set of the shift sleeve (3) and the insert rings (5*a*, 5*b*) may be replaced with another set of insert rings and a shift sleeve having a substantially same inner diameter, which differs from that of the removed set. In this manner, an operator may use a single housing (1, 2) to form apparatuses (100) having different inner diameters, each uniquely fit for use with position shifting tools having different outer diameters.

Figure 6A:
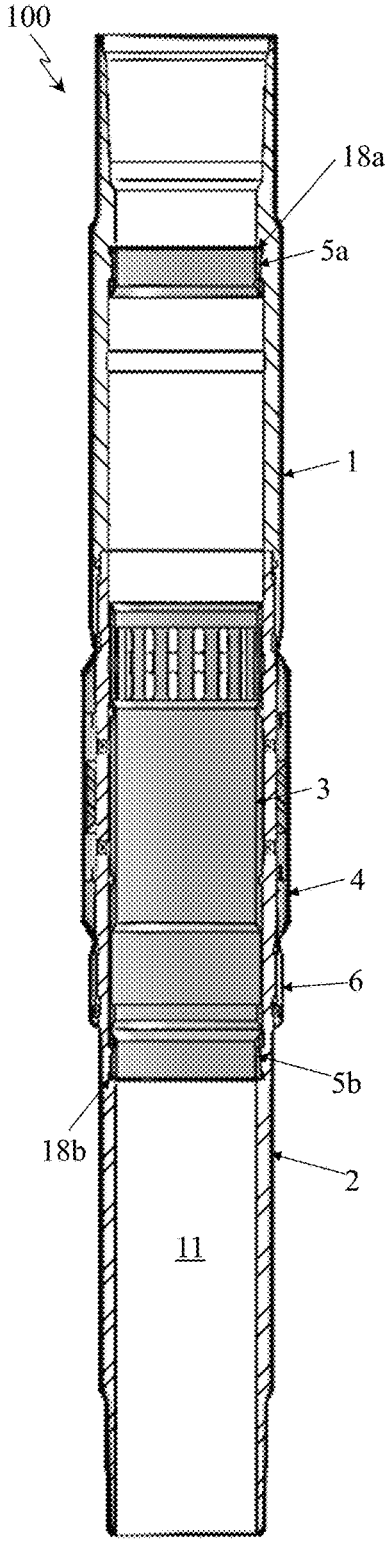
FIGS. 6A, 6B, and 6C show axial half-section views of embodiments of an apparatus of the present invention including a common tubular housing, fitted with interchangeable shift sleeves and insert rings having minimum inner diameters of 3.812 inches (96.8 mm) (FIG. 6A), 3.688 inches (93.7 mm) (FIG. 6B), and 2.812 inches (71.4 mm) (FIG. 6C).
Figure 6B:
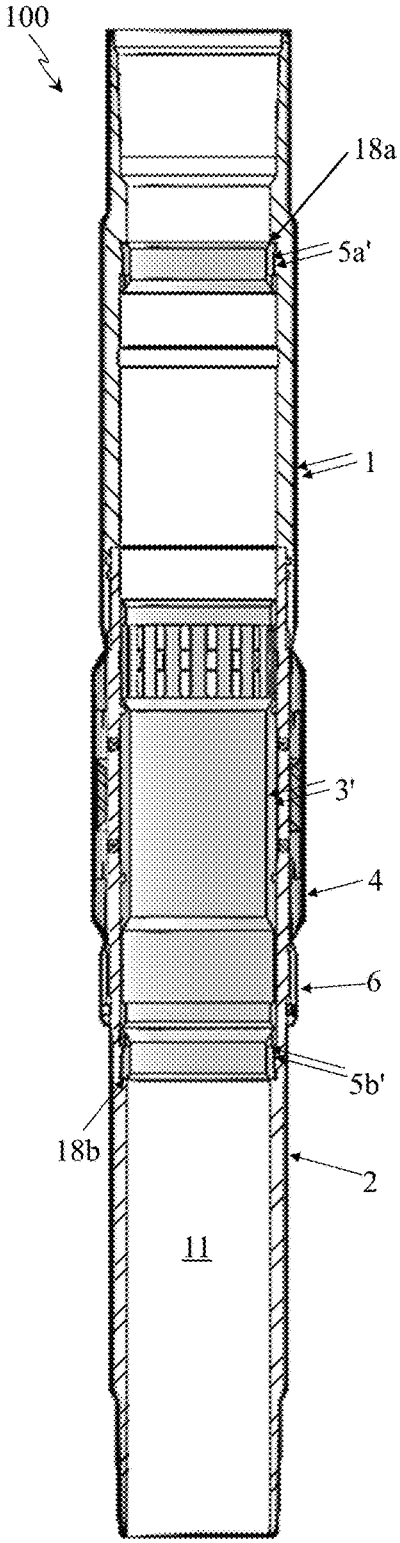
Figure 6C:
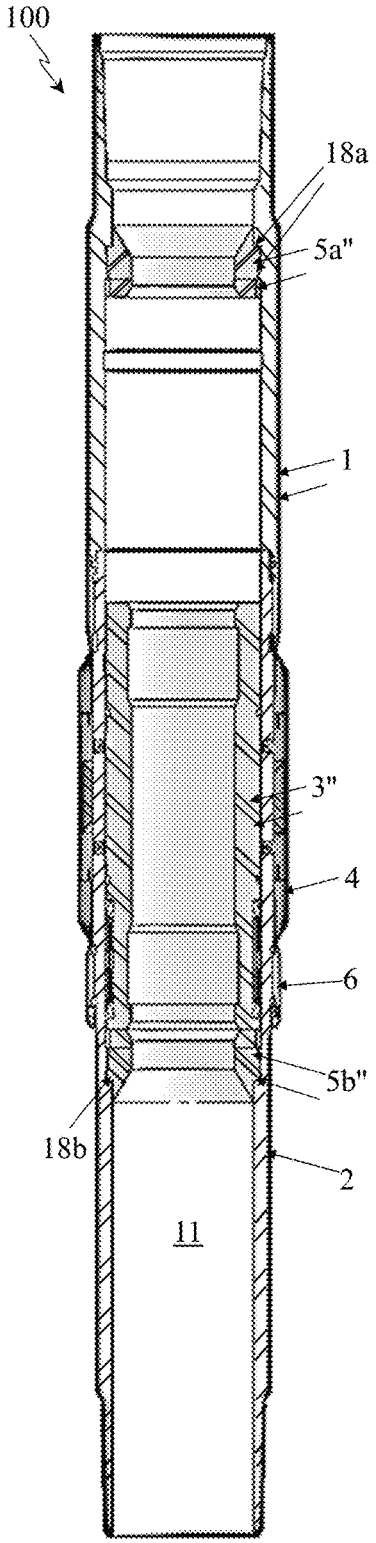

FIGS. 6A to 6C show an embodiment of a kit of parts including the upper housing (1), the lower housing (2), diverter sleeve (4), lock ring (6), and three sets of a shift sleeves (3, 3', 3''') and three sets of insert rings (5*a*, 5*b*; 5*a*', 5*b*'; or 5*a*", 5*b*"). Within each set, the shift sleeve (3; 3'; or 3") and insert rings (5*a*, 5*b*; 5*a*', 5*b*'; or 5*a*", 5*b*") have substantially the same minimum inner diameter, adapted for use with a position shifting tool having a particular outer diameter. As between the sets, however, the shift sleeve (3; 3'; or 3") and insert rings (5*a*, 5*b*; 5*a*', 5*b*'; or 5*a*", 5*b*") have different inner diameters. As such, they will require position shifting tools having different outer diameters. As a non-limiting example, the first set of shift sleeve (3) and insert rings (5*a*, 5*b*) have a minimum inner diameter of about 3.812 inches (96.8 mm) (FIG. 6A), the second set of shift sleeve (3') and insert rings (5*a*', 5*b*') have a minimum inner diameter of about 3.688 inches (93.7 mm) (FIG. 6B); and the third set of shift sleeve (3") and insert rings (5*a*", 5*b*") have a minimum inner diameter of about 2.812 inches (71.4 mm) (FIG. 6C). All three sets of shift sleeves (3; 3'; and 3") and insert rings (5*a*, 5*b*; 5*a*', 5*b*'; and 5*a*", 5*b*") have substantially the same outer diameter so that they may be used with the same housing (1, 2). Each upper insert ring (5*a*, 5*a*', or 5*a*") and lower insert ring (5*b*, 5*b*', or 5*b*") is externally threaded for removable attachment to an internally threaded portion of the inner wall of the upper housing (1) and lower housing (2), respectively. When so attached, the upper insert ring (5*a*, 5*a*', or 5*a*") abuts against an internal shoulder (18*a*) of the upper housing (1), while the lower insert ring (5*b*, 5*b*', or 5*b*") abuts against an internal shoulder (18*b*) of the lower housing (2).

When it is desired to modify the inner diameter of the apparatus (100), the lock ring (6) and diverter sleeve (4) are removed from the housing (1, 2), and the upper housing (1) and the lower housing (2) are detached from each other, as described above. If necessary, any set of shift sleeve (3, 3', or 3"), upper insert ring (5*a*, 5*a*', or 5*a*") and lower insert ring (5*b*, 5*b*', or 5*b*") that is already installed in the housing (1, 2) is removed from the housing (1, 2). The set of the shift sleeve (3, 3', or 3"), upper insert ring (5*a*, 5*a*', or 5*a*"), and lower insert ring (5*b*, 5*b*', or 5*b*") having the desired inner diameter is installed within and the attached to the housing (1, 2), and the apparatus (100) is reassembled. This process may be performed by a field operator, without the need for specialized tools.

Shift Sleeve Locator Gauge.

Figure 7:
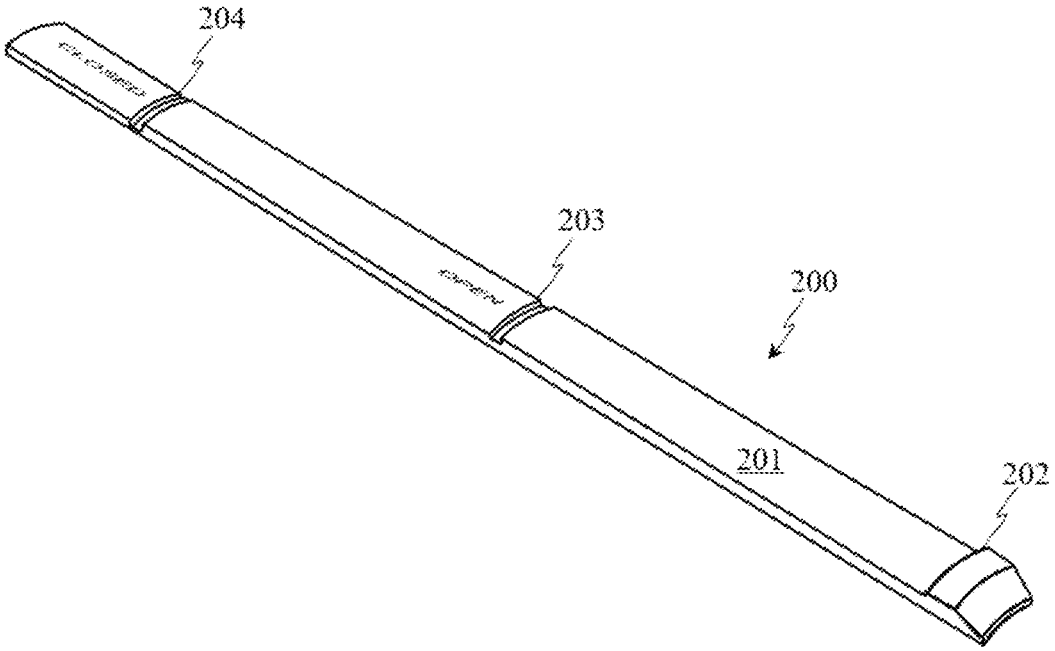
FIG. 7 shows a perspective view of an embodiment of a shift sleeve locator gauge for verifying the position of the shift sleeve of the apparatus of FIG. 2.

FIG. 7 shows an embodiment of a shift sleeve locator gauge (200) for determining whether the shift sleeve (3) is in the open position or closed position. In this embodiment, the shift sleeve locator gauge (200) has a curved outer surface (201) for engaging the inner wall of the shift sleeve (3), and a shoulder profile (202) for engaging the abrupt shoulder (16*b*) of the shift sleeve (3). The gauge (200) has a lower groove (203) labelled "OPEN", and an upper groove (204) labelled "CLOSED". In other embodiments, other suitable visual markings on the gauge (200) may be used to denote the open and closed positions.

In use, an operator inserts the gauge (200) through the uphole end of the apparatus (100). With the outer surface (201) pressed against the inner wall of the shift sleeve (3), the worker pulls the gauge (200) in the uphole direction until the shoulder profile (202) of the gauge (200) engages the abrupt shoulder (16*b*). When so engaged, if the shift sleeve (3) is in the open position (2) (FIGS. 2 and 4), then the lower groove (203) labelled "OPEN" will approximately coincide with the uphole end of the housing (1, 2). Conversely, if the shift sleeve is in the closed position (FIGS. 3 and 5), then the upper groove (204) labelled "CLOSED" will approximately coincide with the uphole end of the housing (1, 2) and the lower groove (203) labelled "OPEN" will be concealed from view within the housing (1, 2). In other embodiments, the gauge may have different visual markings (e.g., color, labels, texture, contours, etc.) to distinguish the open and closed positions.

Exemplary Aspects.

In view of the described apparatuses, and methods and variations thereof, certain more particularly described aspects of the invention are presented below. These particularly recited aspects should not however be interpreted to have any limiting effect on any different claims containing different or more general teachings described herein, or that the "particular" aspects are somehow limited in some way other than the inherent meanings of the language literally used therein.

Aspect 1A: A steam diverter apparatus for forming part of a downhole tubing string, the apparatus comprising: (a) a tubular housing defining an axially extending central bore for communication of fluid with the tubing string, and at least one transversely extending port for communication of steam from the bore to outside of the housing; (b) a shift sleeve removably disposed within the bore, and moveable relative to the housing between a closed position and an open position wherein the shift sleeve prevents and permits, respectively, communication of steam through the at least one port; and (c) at least one insert ring removably attached to the housing, and disposed concentrically within the bore, and axially in line with the shift sleeve, wherein the shift sleeve and the at least one insert ring have a minimum inner diameter that are substantially the same.

Aspect 1B: A method for modifying a minimum inner diameter of a steam diverter apparatus for forming part of a downhole tubing string, the apparatus comprising a tubular housing defining an axially extending central bore for communication of fluid with the tubing string, and at least one transversely extending port for communication of steam from the bore to outside of the housing, and a shift sleeve removably disposed within the bore, and moveable relative to the housing between a closed position and an open position wherein the shift sleeve prevents and permits, respectively, communication of steam through the at least one port from the bore to outside of the housing, the method comprising the step of: removably attaching at least one insert ring to the housing, wherein the at least one insert ring is disposed concentrically within the bore, and axially in line with the shift sleeve, and wherein the shift sleeve and the at least one insert ring have a minimum inner diameter that are substantially the same.

Aspect 1C: A kit for forming a steam diverter apparatus for forming part of a downhole tubing string, the kit comprising: (a) a tubular housing defining an axially extending central bore for communication of fluid with the tubing string, and at least one transversely extending port for communication of steam from the bore to outside of the housing; and (b) at least two sets of parts, wherein each set comprises: (i) a sleeve for removable installation within the bore, and, which when disposed within the bore, is moveable relative to the housing to control communication of steam through the at least one port from the bore to outside of the housing; and (ii) at least one insert ring for removable installation concentrically within the bore, and axially in line with the shift sleeve; wherein, within each set, the shift sleeve and the at least one insert ring have a minimum inner diameter that are substantially the same; and wherein, between the sets, the minimum inner diameters are different.

Aspect 2: The apparatus of Aspect 1A, the method of Aspect 1B, or the kit of Aspect 1C, wherein the at least one insert ring defines a release profile for actuating radial retraction of a key of a position shifting tool when the release profile is engaged by the position shifting tool.

Aspect 3: The apparatus of any one of Aspects 1A to 2, the method of any of Aspects 1B to 2, or the kit of any one of Aspects 1C to 2, wherein the at least one insert ring is removably attached to the housing by a threaded connection.

Aspect 4: The apparatus of any one of Aspects 1A to 3, the method of any of Aspects 1B to 3, or the kit of any one of Aspects 1C to 3, wherein the at least one insert ring abuts an internal shoulder of the housing when attached to the housing.

Aspect 5: The apparatus of any one of Aspects 1A to 4, the method of any of Aspects 1B to 4, or the kit of any one of Aspects 1C to 4, wherein the at least one insert ring comprises an upper insert ring and a lower insert ring, wherein the shift sleeve is disposed axially between the upper insert ring and the lower insert ring.

Aspect 6: The apparatus of Aspect 5, the method of Aspect 5, or the kit of Aspect 5, wherein the housing comprises an upper housing and a lower housing removably attached to the lower housing, wherein the upper insert ring is removably attached to the upper housing, and wherein the lower insert ring is removably attached to the lower housing.

Aspect 7A: A steam diverter apparatus for forming part of a downhole tubing string, the apparatus comprising: (a) a tubular housing defining an axially extending central bore for communication of fluid with the tubing string, and a plurality of transversely extending ports for communication of steam from the bore to outside of the housing; (b) a shift sleeve disposed within the bore, and moveable relative to the housing between a closed position and an open position wherein the shift sleeve prevents and permits, respectively, communication of steam through the ports from the bore to outside of the housing; and (c) at least one plug removably attached to a port, wherein the plug substantially closes the port.

Aspect 7B: A method for modifying an open flow area of a steam diverter apparatus for forming part of a downhole tubing string, the apparatus comprising a tubular housing defining an axially extending central bore for communication of fluid with the tubing string, and a plurality of transversely extending ports for communication of steam from the bore to outside of the housing, and a shift sleeve disposed within the bore, and moveable relative to the housing between a closed position and an open position wherein the shift sleeve prevents and permits, respectively, communication of steam through the ports from the bore to outside of the housing, the method comprising the step of: removably attaching at least one plug to the housing to prevent communication of steam through one of the ports from the bore to outside of the housing.

Aspect 8: The apparatus of Aspect 7A, or the method of Aspect 7B, wherein the at least one plug is removably attached to the port by a threaded connection.

Aspect 9: The apparatus of any one of Aspects 7A to 8, or the method of any one of Aspects 7B to 8, wherein the at least one plug comprises a head adapted for engagement by a drive tool.

Aspect 10: The apparatus of any one of Aspects 7A to 9, or the method of any one of Aspects 7B to 9, wherein the apparatus is further comprising a diverter sleeve disposed around the plugs, removably attached to the housing, and defining at least one conduit for communication of steam from the ports to outside of the diverter sleeve, and wherein the at least one plug is accessible from outside of the housing when the diverter sleeve is detached from the housing.

Aspect 11: The apparatus of Aspect 10, or the method of Aspect 10, wherein the apparatus is further comprising a lock ring that is removably attached to the housing by a threaded connection and that abuts against the diverter sleeve to removably attach the diverter sleeve to the housing.

Aspect 12A: A steam diverter apparatus for forming part of a downhole tubing string, the apparatus comprising: a tubular housing defining an axially extending central bore for communication of fluid with the tubing string, wherein the housing comprises: (a) a first portion that defines at least one transversely extending port for communication of steam from the bore to outside of the housing, wherein the first portion is formed by a first material; and (b) at least one second portion that blocks communication of steam through one of the ports, wherein the second portion is formed by a second material that dissolves at a higher dissolution rate than does the first material when exposed to a chemical solution. The first material may be insoluble in the chemical solution.

Aspect 12B: A method for controlling steam flow into a formation, the method comprising the steps of: (a) including a steam diverter apparatus in a downhole tubing string disposed within the formation, wherein the apparatus comprises a tubular housing defining an axially extending central bore for communication of fluid with the tubing string, wherein the housing comprises: (i) a first portion that defines at least one transversely extending port for communication of steam from the bore to outside of the housing, wherein the first portion is formed by a first material; and (ii) at least one second portion that blocks communication of steam through one of the ports, wherein the second portion is formed by a second material that dissolves at a higher dissolution rate than does the first material when exposed to a chemical solution; and (b) injecting the chemical solution into the tubing string, and allowing the chemical solution to flow into the bore to contact and dissolve the at least one second portion of the housing to thereby unblock the at least one of the ports. The first material may be insoluble in the chemical solution.

Aspect 13: The apparatus of Aspect 12A or the method of Aspect 12B, wherein the apparatus further comprises a shift sleeve disposed within the bore, and moveable relative to the housing between a closed position and an open position wherein the shift sleeve prevents and permits, respectively, communication of steam through the at least one port from the bore to outside of the housing.

Aspect 14: The apparatus of any one of Aspects 12A to 13 or the method of any one of Aspects 12B to 13, wherein the second portion of the housing comprises a plug removably attached to the first portion of the housing.

Aspect 15: The apparatus of Aspects 14 or the method of Aspect 14, wherein the plug is removably attached to the first portion of the housing by a threaded connection.

Aspect 16A: A steam diverter apparatus for forming part of a downhole tubing string, the apparatus comprising: (a) a tubular housing defining an axially extending central bore for communication of fluid with the tubing string, and at least one transversely extending port for communication of steam from the bore to outside of the housing, wherein the housing is formed by a first material; and (b) a shift sleeve disposed within the bore at a closed position wherein the shift sleeve prevents communication of steam through the at least one port from the bore to outside of the housing, and wherein the shift sleeve is formed by a second material that dissolves at a higher dissolution rate than does the first material when exposed to a chemical solution. The first material may be insoluble in the chemical solution.

Aspect 16B: A method for controlling steam flow into a formation, the method comprising the steps of: (a) including a steam diverter apparatus in a downhole tubing string disposed within the formation, wherein the apparatus comprises: (i) a tubular housing defining an axially extending central bore for communication of fluid with the tubing string, and at least one transversely extending port for communication of steam from the bore to outside of the housing, wherein the housing is formed by a first material; and (ii) a sleeve disposed within the bore at a closed position wherein the shift sleeve prevents communication of steam through the at least one port from the bore to outside of the housing, and wherein the shift sleeve is formed by a second material that dissolves at a higher dissolution rate than does the first material when exposed to a chemical solution; and while the sleeve is in the closed position, injecting the chemical solution into the tubing string, and allowing the chemical solution to flow into the bore to contact and dissolve the shift sleeve to thereby permit communication of steam through the at least one port from the bore to outside of the housing. The first material may be insoluble in the chemical solution.

Aspect 17: The apparatus of Aspect 16A, or the method of Aspect 16B, wherein the sleeve comprises a shift sleeve movable relative to the housing between the closed position and an open position wherein the shift sleeve permits communication of steam through the at least one port from the bore to outside of the housing Interpretation.

The corresponding structures, materials, acts, and equivalents of all means or steps plus function elements in the claims appended to this specification are intended to include any structure, material, or act for performing the function in combination with other claimed elements as specifically claimed.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

The invention claimed is:

1. A steam diverter apparatus for forming part of a downhole tubing string, the apparatus comprising:

(a) a tubular housing defining an axially extending central bore for communication of fluid with the tubing string, and at least one transversely extending port for communication of steam from the bore to outside of the housing;

(b) a shift sleeve removably disposed within the bore, and moveable relative to the housing between a closed position and an open position wherein the shift sleeve prevents and permits, respectively, communication of steam through the at least one port from the bore to outside of the housing; and (c) at least one insert ring removably attached to the housing, and disposed concentrically within the bore, and axially in line with the shift sleeve, wherein the shift sleeve and the at least one insert ring have a minimum inner diameter that are substantially the same, wherein the at least one insert ring is fixed in position within the tubular housing and together with the shift sleeve to form a release profile for a position shifting tool, and wherein the at least one insert ring comprises an upper insert ring and a lower insert ring, wherein the shift sleeve is disposed axially between the upper insert ring and the lower insert ring.

2. The steam diverter apparatus of claim 1, wherein the at least one insert ring is removably attached to the housing by a threaded connection.

3. The steam diverter apparatus of claim 1, wherein the at least one insert ring abuts an internal shoulder of the housing when attached to the housing.

4. The steam diverter apparatus of claim 1, wherein the housing comprises an upper housing and a lower housing removably attached to the lower housing, wherein the upper insert ring is removably attached to the upper housing, and wherein the lower insert ring is removably attached to the lower housing.

5. A method for modifying a minimum inner diameter of a steam diverter apparatus for forming part of a downhole tubing string, the apparatus comprising a tubular housing defining an axially extending central bore for communication of fluid with the tubing string, and at least one transversely extending port for communication of steam from the bore to outside of the housing, and a shift sleeve removably disposed within the bore, and moveable relative to the housing between a closed position and an open position wherein the shift sleeve prevents and permits, respectively, communication of steam through the at least one port from the bore to outside of the housing, the method comprising the step of:

removably attaching at least one insert ring to the housing, wherein the at least one insert ring is disposed concentrically within the bore in a fixed position, and axially in line with the shift sleeve, wherein the shift sleeve and the at least one insert ring have a minimum inner diameter that are substantially the same and cooperate to form a release profile for a position shifting tool, and wherein the at least one insert ring comprises an upper insert ring and a lower insert ring, wherein the shift sleeve is disposed axially between the upper insert ring and the lower insert ring.

6. The method of claim 5, wherein removably attaching the at least one insert ring to the housing comprises attaching the at least one insert ring to the housing by a threaded connection.

7. The method of claim 5, wherein the at least one insert ring abuts an internal shoulder of the housing when attached to the housing.

8. The method of claim 5, wherein the housing comprises an upper housing and a lower housing removably attached to the lower housing, and wherein removably attaching the at least one insert ring to the housing comprises removably attaching the upper insert ring to the upper housing, and removably attaching the lower insert ring to the lower housing.

9. A kit for forming a steam diverter apparatus for forming part of a downhole tubing string, the kit comprising:

(a) a tubular housing defining an axially extending central bore for communication of fluid with the tubing string, and at least one transversely extending port for communication of steam from the bore to outside of the housing; and (b) at least two sets of parts, wherein each set comprises:

(i) a sleeve for removable installation within the bore, and, which when disposed within the bore, is moveable relative to the housing to control communication of steam through the at least one port from the bore to outside of the housing;

(ii) at least one insert ring for removable installation in a fixed position concentrically within the bore, and axially in line with the shift sleeve;

wherein, within each set, the shift sleeve and the at least one insert ring cooperate to form a release profile for a position shifting tool and have a minimum inner diameter that are substantially the same, between the sets, the minimum inner diameters are different, and the at least one insert ring comprises an upper insert ring and a lower insert ring, wherein the shift sleeve is disposed axially between the upper insert ring and the lower insert ring, when the insert rings and the shift sleeve are installed in the bore.

10. The kit of claim 9, wherein the at least one insert ring is removably attached to the housing by a threaded connection.

11. The kit of claim 9, wherein the at least one insert ring abuts an internal shoulder of the housing when attached to the housing.

12. The kit of claim 9, wherein the housing comprises an upper housing and a lower housing removably attached to the lower housing, wherein the upper insert ring is removably attachable to the upper housing, and wherein the lower insert ring is removably attachable to the lower housing.

* * * * *